US005704426A

United States Patent [19]

Rytlewski et al.

[11] Patent Number: 5,704,426

[45] Date of Patent: Jan. 6, 1998

[54] ZONAL ISOLATION METHOD AND APPARATUS

[75] Inventors: Gary L. Rytlewski, League City; Dale E. Meek, Sugar Land, both of Tex.

[73] Assignee: Schlumberger Technology Corporation, Sugarland, Tex.

[21] Appl. No.: 619,781

[22] Filed: Mar. 20, 1996

[51] Int. Cl.[6] ..... F21B 43/116

[52] U.S. Cl. ..... 166/297; 175/4.52

[58] Field of Search ..... 166/297, 298, 166/386, 55, 123, 135; 175/4.52

[56] References Cited

U.S. PATENT DOCUMENTS

| | | | |
|---|---|---|---|
| 2,769,497 | 11/1956 | Reistle, Jr. | 166/297 |
| 3,433,305 | 3/1969 | Bell | 166/297 |
| 3,856,094 | 12/1974 | Davis | 166/297 X |
| 5,044,437 | 9/1991 | Wittrisch | 175/4.52 X |
| 5,353,875 | 10/1994 | Schultz et al. | 166/297 |

*Primary Examiner*—William P. Neuder

*Attorney, Agent, or Firm*—Gordon G. Waggett; John H. Bouchard; John J. Ryberg

[57] ABSTRACT

A new zonal isolation method and apparatus perforates a plurality of zones of a formation, while isolating each perforated zone from every other zone, with one trip into wellbore, and without requiring the circulation of a kill fluid throughout the wellbore following perforation to kill the well so that a packer and/or a perforating gun may be removed from the well. The new zonal isolation apparatus includes a perforating gun and a plug or packer connected to the perforating gun. The new zonal isolation method includes detonating the perforating gun thereby creating a set of perforations in the formation; moving the perforating gun and plug/packer uphole until the plug/packer is situated at a particular position in the wellbore which is disposed directly above the set of perforations in the formation; and setting the plug/packer at the particular position in the wellbore. The perforated zones located below the plug/packer are isolated from annulus fluids, pressure, or kill fluids which are normally introduced above the plug/packer in the wellbore.

10 Claims, 7 Drawing Sheets

30

38
36
34
33
32
42

38
40
36
34
42
30
32
33

26
24
22
20
10
12
24
20

14
16
18
20a
20
10
12

56
58
66
50
50b
60
64
64
74
80
78
76
74
82
70
72

141
129
130
132
134
136
138
140
142
144
146

150
166
152
154
156
160
158
162
164

ZONAL ISOLATION METHOD AND APPARATUS

BACKGROUND OF THE INVENTION

The subject matter of the present invention relates to a zonal isolation method and apparatus for isolating a first perforated interval of a plurality of intervals from a second interval prior to perforating the second interval, and, more particularly, to a new method of perforating, testing, and/or stimulating each zone of a plurality of zones of a formation penetrated by a wellbore, with one trip into the wellbore, and isolating each zone from every other zone prior to perforating the other zone thereby preventing a kill fluid from damaging the perforated zones after the perforating, testing, and/or stimulation operations are completed and before a completion string is run into the wellbore.

A first conventional method of perforating a plurality of intervals of formation penetrated by a wellbore to produce a multiple number of perforated zones in the formation includes locating a first bridge plug below a zone to be perforated, lowering an apparatus into a wellbore which includes a packer and a perforating gun disposed below the packer in the wellbore until the perforating gun is adjacent a first zone to be perforated, setting the packer, detonating the perforating gun while it is disposed adjacent the first zone to be perforated, using a kill fluid to kill the well, unsetting the packer and retrieving the packer and the perforating gun to a surface of the wellbore, setting a second bridge plug above the first perforated zone, lowering a second perforating gun and then a second packer into the wellbore until the second perforating gun is adjacent another, second zone to be perforated which is above the first zone, setting the second packer, detonating the second perforating gun, killing the well adjacent the second zone, and repeating the above referenced procedure until the multiple number of perforated zones exist in the formation which are separated by a corresponding multiple number of bridge plugs.

A second conventional method of perforating a plurality of intervals of formation penetrated by a wellbore includes lowering a first packer above a first production tubing conveyed perforating gun into a wellbore until the fast perforating gun is disposed adjacent a first zone to be perforated, setting the first packer, detonating the first production tubing conveyed perforating gun, dropping the first perforating gun to a bottom of the wellbore, lowering a second small "through the tubing" perforating gun by wireline through the production tubing until the second perforating gun is disposed adjacent a second zone to be perforated, perforating the second zone, and retrieving the second perforating gun through the production tubing and through the set packer.

In either case, a kill fluid in an overbalanced condition is used to kill the perforated zones prior to retrieving the packer and the perforating guns to a surface of the wellbore.

While the aforementioned conventional methods of perforating a plurality of intervals of formation penetrated by a wellbore are adequate and sufficient for some purposes, when either conventional method is used, a kill fluid in an overbalanced condition is circulated through the well to achieve overbalance and to kill the well after the perforating or testing or stimulation operations are completed and prior to the retrieval of the packer and/or the perforating guns to a surface of the wellbore.

However, the overbalanced kill fluid can damage the perforated zones of the formation. In addition, when using the first conventional method, a multiple number of bridge plugs must be left in the wellbore to separate the multiple number of perforated zones in the wellbore. Furthermore, the conventional methods of perforating a plurality of intervals of the formation may require a deep well in order to adequately perform the method. For example, a deep well would be needed to drop the perforating gun to a bottom of the wellbore.

Therefore, another new method and apparatus for perforating the plurality of intervals or zones of the formation penetrated by the wellbore is needed, one which will isolate each perforated zone of a plurality of perforated zones of the formation from the next zone of the formation to be perforated, this "zonal isolation" method taking place prior to perforating the next zone. The aforementioned "zonal isolation" method and apparatus would not require the circulation of a kill fluid, in an overbalanced condition, through a perforated zone of the formation immediately following the perforation of the zone. In addition, a deep well is not necessarily needed to practice the new zonal isolation method and associated apparatus.

SUMMARY OF THE INVENTION

It is a primary object of the present invention to provide a new zonal isolation method and apparatus adapted for perforating a plurality of intervals or zones of a formation penetrated by a wellbore with one trip into the wellbore which does not require the circulation of a kill fluid through the wellbore after performing a perforating operation and before retrieving a packer and a perforating gun to a surface of the wellbore.

It is a further object of the present invention to provide a new zonal isolation method and apparatus adapted for perforating a plurality of intervals or zones of a formation penetrated by a wellbore with one trip into the wellbore and isolating each perforated zone of the formation from the next adjacent zone of the formation to be perforated prior to perforating the next zone.

It is a further object of the present invention to provide the new zonal isolation method and apparatus, adapted for perforating a plurality of intervals or zones of a formation penetrated by a wellbore with one trip into the wellbore and isolating each perforated zone of the formation from the next adjacent zone of the formation to be perforated prior to perforating the next zone, including the steps of: circulating out the kill fluid in the wellbore to achieve an underbalanced condition in the wellbore, perforating by a tubing conveyed perforating gun one or more zones in the wellbore thereby producing perforated zones in the wellbore while maintaining the underbalanced condition in the wellbore, protecting each zone of the perforated zones from kill fluids after perforating said each zone by setting a production packer above said each zone and temporarily isolating said each zone from the remainder of the wellbore, releasing wellhead pressure, and retrieving the perforating gun.

It is a further object of the present invention to provide the new zonal isolation method and apparatus, adapted for perforating a plurality of intervals or zones of a formation penetrated by a wellbore with one trip into the wellbore and isolating each perforated zone of the formation from the next adjacent zone of the formation to be perforated prior to perforating the next zone including the steps of: setting a retrievable packer or plug, perforating the first zone in the wellbore situated above the packer or plug, unsetting the packer or plug and moving the packer or plug uphole to the next zone which situated above the perforated first zone, setting the packer or plug adjacent the next zone, retrieving the perforating gun when the packer or plug is set adjacent the next zone, latching a production tubing into the plug or packer, flowing a wellbore fluid uphole from the perforated first zone through the production tubing, detaching the production tubing from the plug or packer when the wellbore fluid no longer flows from the perforated first zone, lowering another perforating gun downhole and attaching the perforating gun to the plug or packer, perforating the next zone in the wellbore situated above the packer or plug, and repeating the above procedure until all of the plurality of intervals or zones of the formation have been perforated.

It is a further object of the present invention to provide the new zonal isolation method and apparatus adapted for perforating a plurality of intervals or zones of a formation penetrated by a wellbore with one trip into the wellbore and isolating each perforated zone of the formation from the next adjacent zone of the formation to be perforated prior to perforating the next zone including the steps of: perforating a first zone of the formation, plugging or packing off the first zone at a location situated above the first zone in the wellbore, perforating a second zone of the formation, plugging or packing off the second zone at a location situated above the second zone in the wellbore, perforating a third zone of the formation, and plugging or packing off the third zone at a location situated above the third zone in the wellbore.

In accordance with these and other objects of the present invention, four embodiments of the new zonal isolation method and apparatus of the present invention are disclosed. The new zonal isolation method and apparatus is adapted for: (1) perforating a plurality of intervals or zones of a formation penetrated by a wellbore with one trip into the wellbore, and, during the perforating, (2) isolating each perforated zone of the formation from the next adjacent zone of the formation to be perforated prior to perforating the next zone. In all of the embodiments, each of the new zonal isolation methods include the steps of: perforating a formation penetrated by the wellbore during one trip into the wellbore and producing a perforated zone in the formation, and setting an isolation packer or plug above the perforated zone, prior to perforating the next adjacent zone of the formation, in order to isolate the perforated zone, which is located below the packer or plug, from annulus fluids, pressure, or kill fluids which are normally introduced above the packer or plug in the wellbore.

In accordance with the first embodiment of the present invention, the new zonal isolation apparatus includes a packer completion apparatus, and the packer completion apparatus further includes a coiled tubing, a firing head and circulating valve connected to the coiled tubing, a perforating gun connected to the firing head, a packer setting tool connected to the perforating gun, and a below gun packer with a plug or valve or a below gun bridge plug connected to the setting tool. The new zonal isolation method, in accordance with the first embodiment, which utilizes the new zonal isolation apparatus, includes: running the packer completion apparatus to a first zone in the wellbore and using the perforating gun to perforate the wellbore, leaving a perforated zone in the wellbore. The below gun packer or bridge plug is unset and the packer completion apparatus is moved upwardly to a second zone in the wellbore. The below gun packer or bridge plug is set adjacent the second zone in the wellbore. When the packer or bridge plug is set, the coiled tubing, firing head and circulating valve, perforating gun, and packer setting tool are disconnected from the below gun packer or bridge plug and are retrieved to a surface of the wellbore, leaving the packer or bridge plug set adjacent the second zone in the wellbore. A production tubing can now be run into the set packer. When the production tubing is run into the packer, a wellbore fluid can now begin to flow from the perforated zone in the wellbore, through a full bore within the packer, and through the production tubing, to a surface of the wellbore. This process can be repeated leaving a multiple number of perforated zones in the wellbore and a corresponding multiple number of set packers or bridge plugs separating the multiple zones from one another in the wellbore.

In accordance with the second and third embodiments of the present invention, the new zonal isolation method and apparatus includes a perforating gun and attached bridge plug connected to a tubing string in a deviated wellbore, the tubing being sealed to a casing by an isolation packer. The casing is disposed above a deviated liner in the deviated wellbore, the liner having a smaller diameter than the casing, the liner and casing meeting at a junction point in the wellbore. The new zonal isolation method, which utilizes the new zonal isolation apparatus, includes the steps of: detonating the perforating gun when the perforating gun is disposed adjacent a zone of the deviated wellbore within the liner to be perforated, leaving a perforated zone in an earth formation penetrated by the wellbore. The bridge plug is then unset. When the perforating gun is detonated, the tubing, the perforating gun, and the bridge plug are moved upwardly in the deviated wellbore until the bridge plug is disposed adjacent the junction point within the liner in the wellbore. The bridge plug is set against the liner at the junction point, and the perforating gun and associated isolation packer are retrieved to a surface of the wellbore. A production tubing and associated completion packer are run into the wellbore, the completion packer being set against the casing above the junction point of the liner. A central core of the bridge plug is pushed out and removed, leaving a full bore within the bridge plug. Since the production tubing is run into the full bore of the bridge plug, a full bore now exists within the production tubing, extending from the completion packer, through the bridge plug, to the perforated zone in the wellbore. Wellbore fluid can now flow from the perforated zone in the wellbore through the bridge plug, through the production tubing, and through the completion packer to a surface of the wellbore.

In accordance with the fourth embodiment of the present invention, the new zonal isolation method and apparatus includes a tool string which comprises a plurality of perforating guns adapted to be lowered into a wellbore by wireline or coiled tubing and adapted for perforating, respectively, a corresponding plurality of intervals of a formation, and a respective plurality of plugs adapted to set connected to the plurality of perforating guns. In operation, when the tool string is situated in the wellbore, a first perforating gun of the tool string perforates a first interval of the formation, and, when the first interval is perforated, the tool string is raised upwardly in the wellbore until a first plug is situated above the first interval. The first plug is set, and a second perforating gun perforates a second interval of the formation. The tool string is raised upwardly in the wellbore until a second plug is situated above the second interval. The second plug is set, and a third perforating gun perforates a third interval of the formation. The tool string is raised upwardly in the wellbore until a third plug is situated above the third interval. The third plug is set. Alternatively, instead of using a plurality of plugs, a single plug is set above the third interval when the first, second, and third intervals of the formation are perforated.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 11–14*d* illustrate other embodiments of the zonal isolation method and apparatus in accordance with the present invention.

DETAILED DESCRIPTION OF THE PREFERRED EMBODIMENT

Figures 1A, 1B, 2, 3, 4:
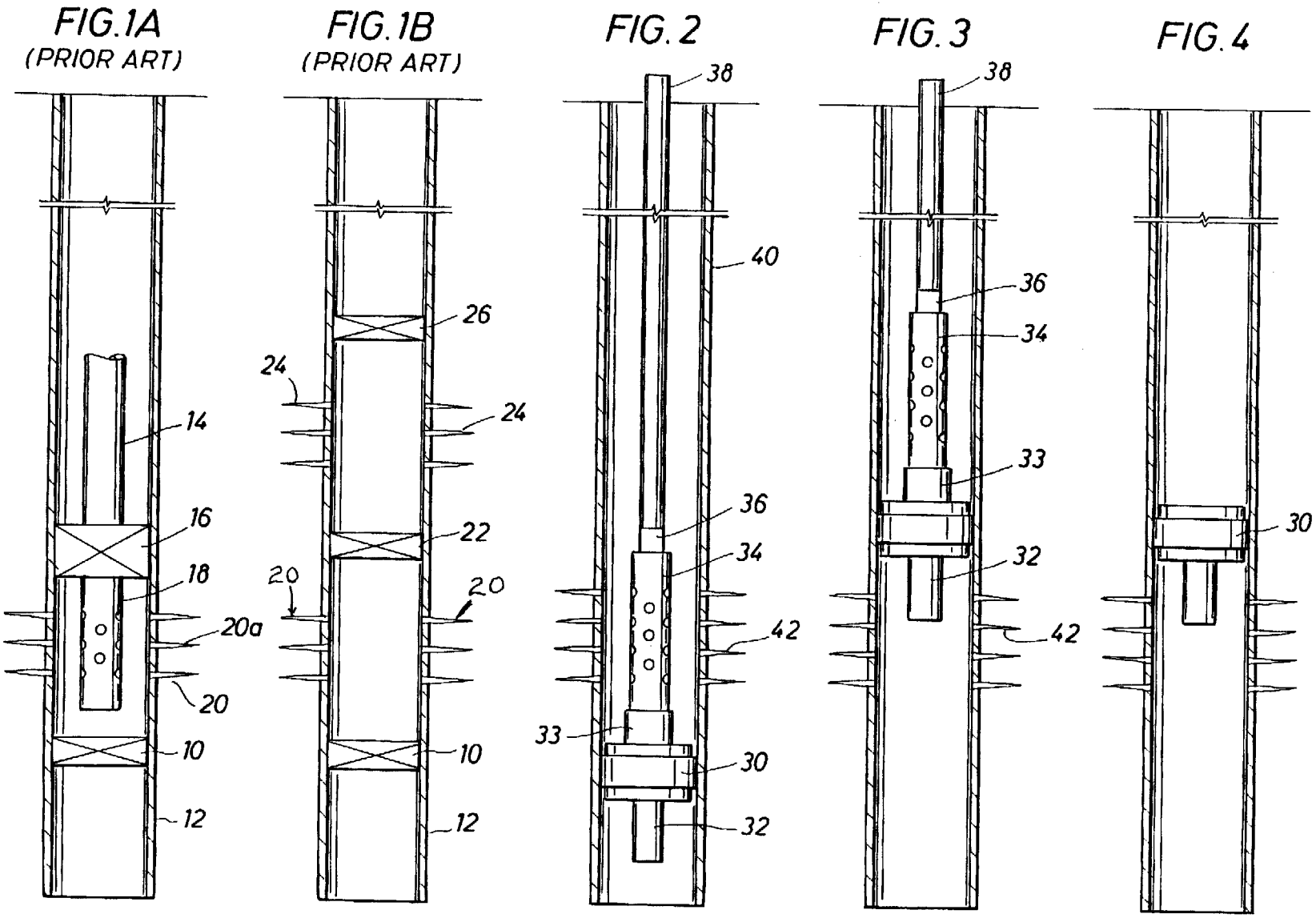
FIG. 1B (PRIOR ART)
FIG. 1A (PRIOR ART)
FIGS. 1A and 1B illustrate a prior art method of perforating a plurality of intervals of a wellbore.
FIGS. 2 through 4 illustrate a first embodiment of the zonal isolation method and apparatus in accordance with the present invention, the fast embodiment including a below gun plug or packer completion apparatus, and corresponding zonal isolation method, for perforating a wellbore with one trip into the wellbore.

In FIGS. 1A and 1B, a prior art method of perforating a wellbore is illustrated.

In FIG. 1A, a plug 10 has already been set in a wellbore 12 and an apparatus 14 is lowered into the wellbore 12, the apparatus 14 including a packer 16 and a perforating gun 18. The perforating gun 18 is disposed adjacent a fast zone 20 to be perforated. When the gun 18 detonates, it leaves a plurality of perforations 20*a* in the first zone 20. At this point, it is necessary to kill the well. To kill a well, a kill fluid circulates among the perforations 20*a*, the kill fluid being in an overbalanced condition; that is, the pressure of the kill fluid in the wellbore is greater than the formation pressure within the perforations 20*a*. As a result, formation fluid, attempting to exit the perforations 20*a* and flow into the wellbore 12 cannot flow into the wellbore because the kill fluid is preventing the wellbore fluid from flowing into the wellbore. When the kill fluid kills the well, the packer 16 is unset and the packer 16 and perforating gun 18 are moved uphole.

In FIG. 1B with alternate reference to FIG. 1A, another plug 22 is set above the perforations 20*a*. Then, the packer 16 and another perforating gun 18 are lowered back into the wellbore to a second zone 24 to be perforated, the packer 16 is set, the perforating gun 18 is detonated mating a second set of perforations in the second zone 24, kill fluid is re-circulated in the wellbore, the packer 16 and perforating gun 18 are retrieved uphole, and another plug 26 is set above the second set of perforations in the second zone 24.

When using this method, a plurality of plugs 10, 22, and 26 are left in the wellbore. In order to produce wellbore fluid in the wellbore 12, it is necessary to drill through the plugs 10, 22, and 26.

Referring to FIGS. 2 through 14*d*, several embodiments of invention are illustrated representing zonal isolation methods of perforating a wellbore during one trip into the wellbore without circulating a kill fluid through the wellbore. All embodiments represent a zonal isolation process involving perforating the well, retrieving the perforating gun, and setting an isolation packer or plug above the perforations in the formation. As a result, a kill fluid need not be circulated among the perforations in the formation, since the kill fluid can potentially damage the perforations in the formation. However, each embodiment differs slightly in the exact manner by which its zonal isolation process or procedure is implemented, as described below.

Referring to FIGS. 2 through 4, a fast embodiment of a zonal isolation method and apparatus is illustrated. In this first embodiment, a below gun plug or packer completion apparatus, and corresponding zonal isolation method, for perforating a wellbore with one trip into the wellbore is illustrated.

In FIG. 2, the first embodiment of the zonal isolation apparatus illustrates a below gun plug/packer completion apparatus is disposed in a wellbore 40. The packer completion apparatus includes a packer 30 having a plug or valve or a bridge plug 30 with an attached tail pipe 32. The packer or plug 30 is connected to: (1) a setting tool 33 having a hydraulic time delay trigger actuated by a perforating gun or having a controller trigger actuated by pressure pulses, (2) the setting tool 33 being connected to the perforating gun 34, (3) the perforating gun 34 being connected to a firing bead and circulating valve 36, and (4) the firing head/circulating valve 36 being connected to a coiled tubing 38 or a production tubing 38 with snubbing capability. The perforating gun 34 is adapted to detonate and produce a plurality of perforations 42 in a formation penetrated by the wellbore 40.

A zonal isolation method for perforating a wellbore with one trip in the wellbore, in accordance with a fast embodiment of the present invention, is practiced by using the packer completion apparatus of FIGS. 2 through 4. That method for perforating a wellbore is set forth in the following paragraphs with reference to FIGS. 2 through 4.

Starting with FIG. 2, when the packer completion apparatus is positioned in the wellbore 40 as shown, the packer 30 is set, and, when the packer 30 is set, the perforating gun 34 detonates, thereby producing the perforations 42 in a fast zone 42 of the formation penetrated by the wellbore 40. Following detonation of the perforating gun 34, the packer/plug 30 is unset and the packer/plug 30, the perforating gun 34, and the coiled tubing-production tubing 38 is moved upwardly in the wellbore, as shown in FIG. 3. The packer/plug 30 is set in the position in the wellbore 40 as shown in FIG. 3. The setting tool 33, the perforating gun 34, the firing head 36, and the coiled tubing-production tubing 38 are disconnected from the packer/plug 30 and are withdrawn to a surface of the wellbore 40 leaving the packer/plug 30 set in the wellbore 40, as shown in FIG. 4. Production tubing can now be run into the wellbore 40 and inserted into the set packer/plug 30. When the production tubing is inserted into the packer/plug 30 of FIG. 4, wellbore fluid can now flow from the perforations 42, through the packer/plug 30, through the production tubing and uphole to a surface of the wellbore. When a second zone of the wellbore should be perforated, another, second setting tool 33, a second perforating gun 34, another firing head 36, and coiled tubing-production tubing 38 (not shown in FIG. 4) are run into the wellbore 40 of FIG. 4 and connected to the set packer/plug 30. The packer 30 in FIG. 4 is set, and, when the packer 30 is set, the second perforating gun 34 detonates, thereby producing another set of perforations in a second zone of the formation penetrated by the wellbore 40. The above referenced procedure repeats until a plurality of sets of perforations are produced in the wellbore 40.

By using the above referenced zonal isolation method for perforating a wellbore with one trip in the wellbore, in accordance with a first embodiment of the present invention shown in FIGS. 2–4, it is not necessary to circulate a kill fluid throughout the sets of perforations, as was necessary in connection with the prior art method described above with reference to FIGS. 1A and 1B of the drawings. Recalling that some methods of perforation require the perforating gun to be dropped to a bottom of the wellbore, the perforating gun 34 of FIGS. 2–4 can be retrieved to a surface of the wellbore 40. In addition, when the above referenced zonal isolation method for perforating a well of FIGS. 2–4 is used, the drilling rig can be removed just after setting casing and the well can be completed rigless when using coiled tubing as part of the completion string or a workover rig to run tubing into the wellbore. Furthermore, with only one trip into the wellbore 40, one can: (1) circulate out kill fluid producing an underbalanced fluid, (2) perforate the zone underbalanced, (3) protect the zone from kill fluids, (4) set a production packer, (5) temporarily isolate the production zone, (6) release wellhead pressure, and (7) retrieve the perforating gun. Furthermore, the above referenced method of completing a well could be adapted to multiple zones by using a retrievable packer or plug and adding the capability of latching onto the plug or packer and moving it before and/or after perforating.

The first embodiment of FIGS. 2–4 indicates that a production tubing is inserted into a first packer/plug 30 which is set in the wellbore and, when the tubing is inserted into the set packer/plug 30, the well can produce (wellbore fluid will flow uphole).

On the other hand, the second embodiment of invention, to be described below with reference to FIGS. 5–10, also requires that a first packer/plug be set; however, in addition, in the second embodiment, a separate packer is also run into the wellbore and set and the first packer/plug is unset and pushed to a bottom of the wellbore. At this point, the well can produce. The second embodiment of invention of FIGS. 5–10 represents a zonal isolation method and apparatus for perforating and/or testing and/or stimulating one or more zones of a formation penetrated by a wellbore, with one trip into the wellbore, without requiring that a kill fluid be circulated, and subsequently isolating the perforated zones from annulus fluid, kill fluid, and pressure. This second embodiment of the zonal isolation method utilizes a modified bridge plug or other packer to isolate the perforated or stimulated zones of the formation from annulus fluid, annulus pressure, and from a kill fluid which, in the prior art, normally circulates through the wellbore after the perforating, testing, and/or stimulating operations have taken place. The bridge plug or packer isolates the zones while tripping tools and tubing into and out of the well and before a completion string is run into the wellbore.

Figure 5:
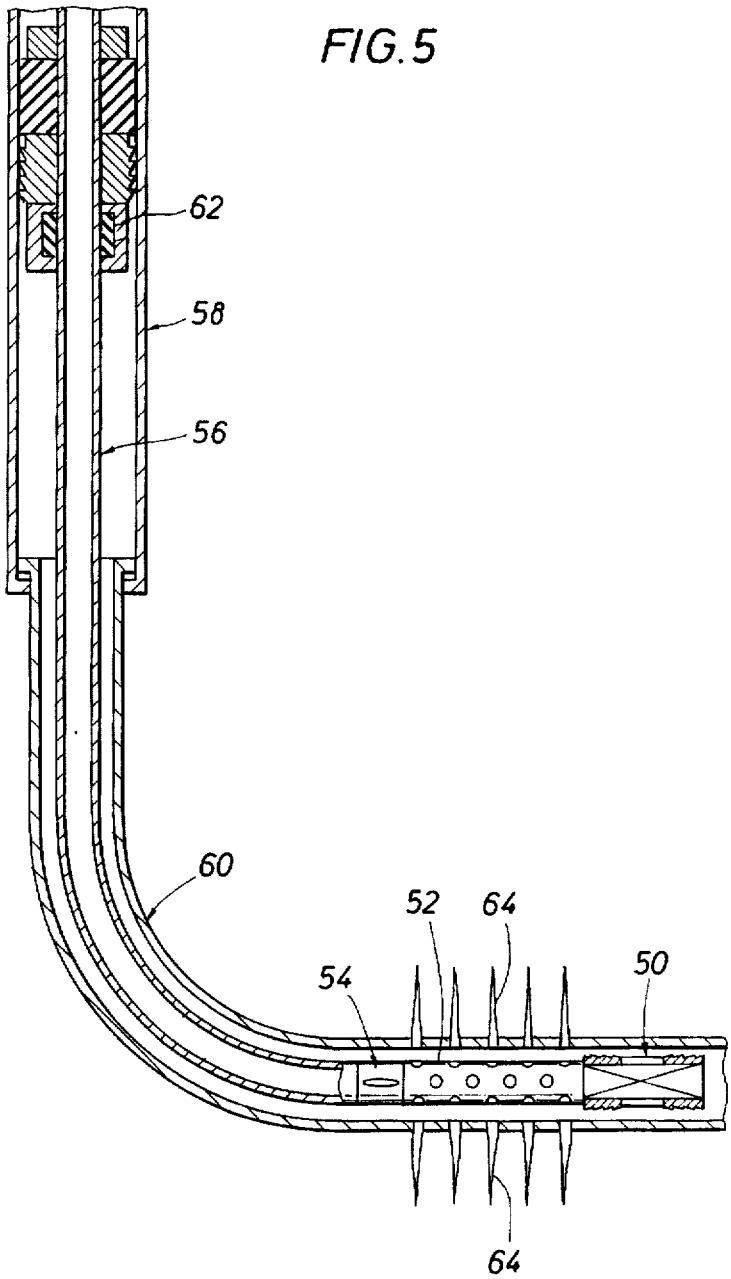
FIGS. 5 through 7 illustrate a second embodiment of the zonal isolation method and apparatus in accordance with the present invention, the second embodiment including an isolation packer system, and corresponding zonal isolation method, for perforating a wellbore with one trip into the wellbore.
Figure 6:
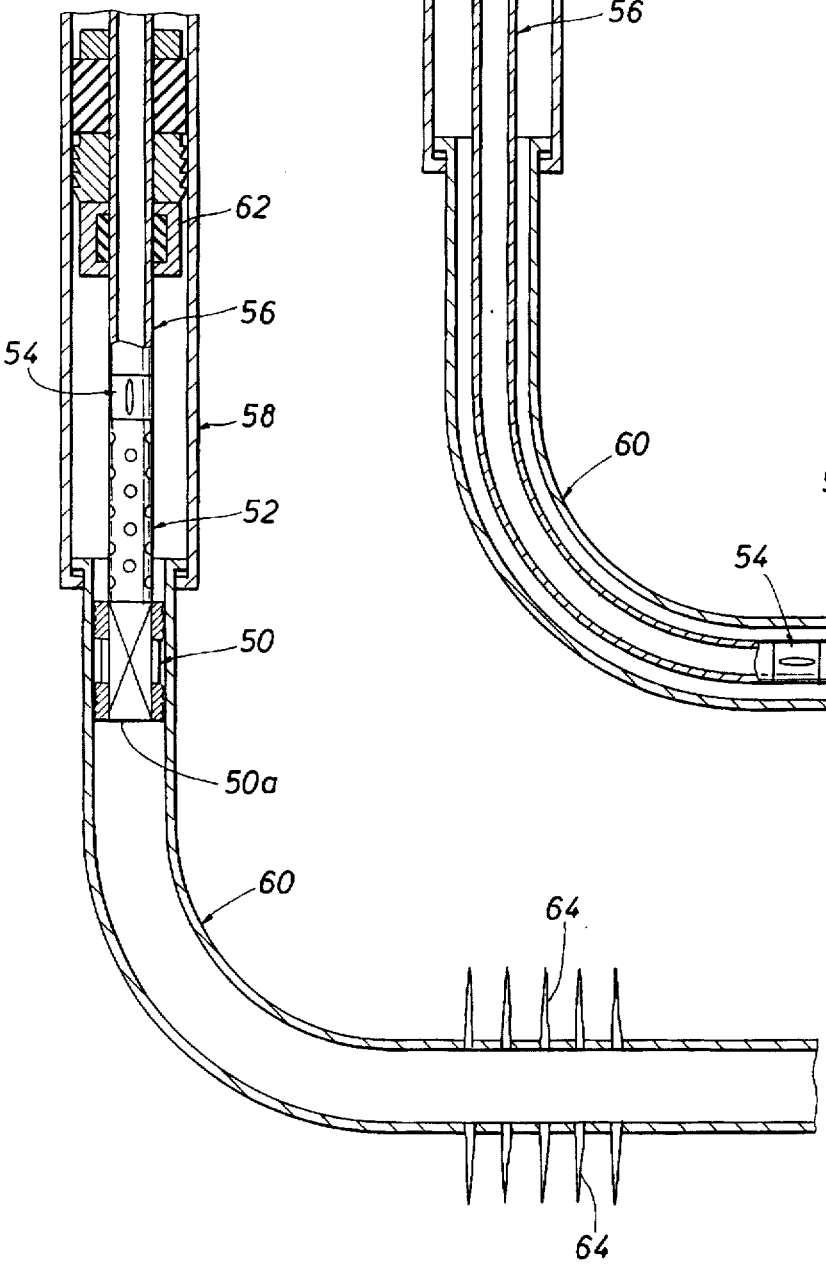
Figures 7, 8:
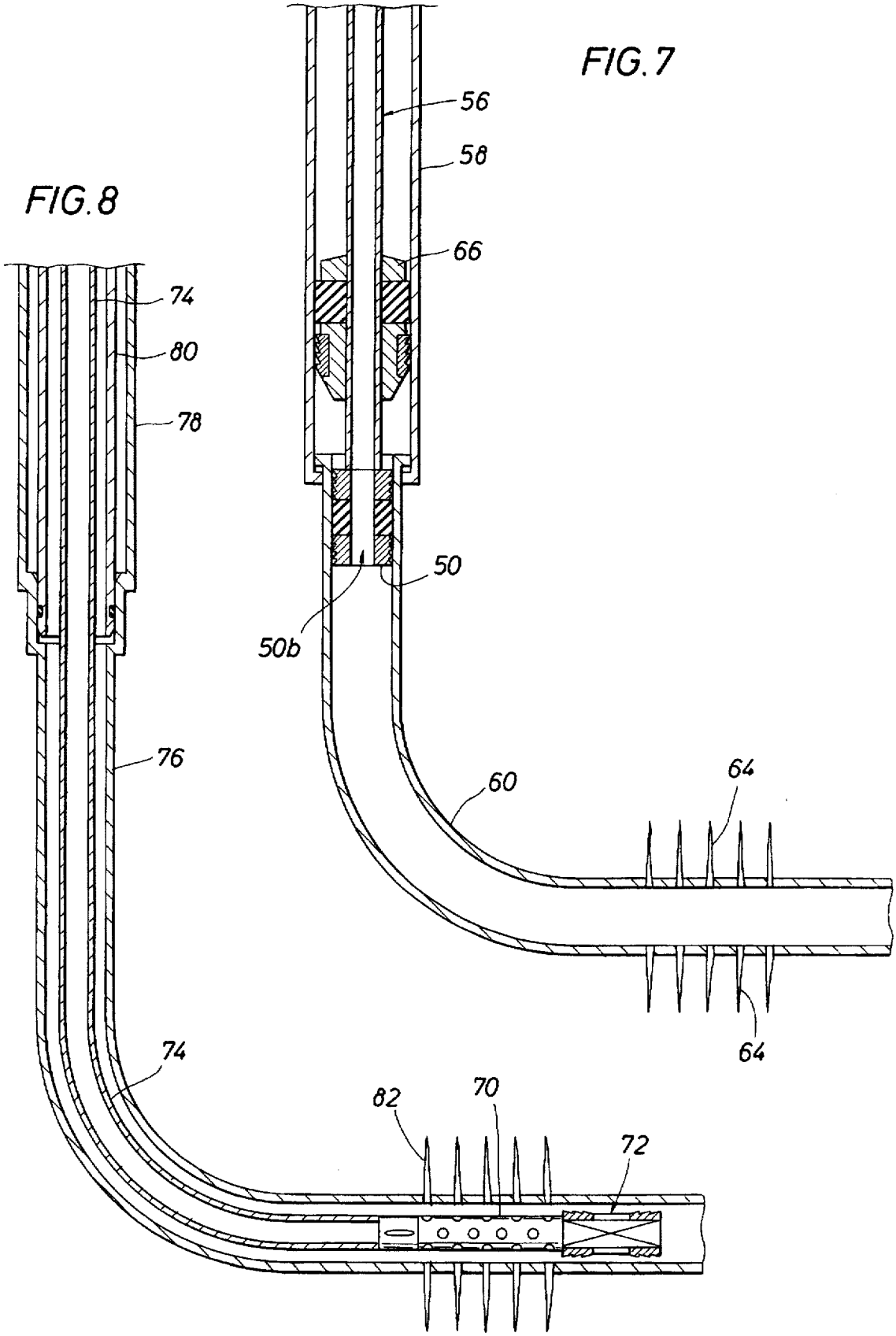
FIGS. 8 and 9 illustrate a third embodiment of the zonal isolation method and apparatus in accordance with the present invention, the third embodiment including a further embodiment of the isolation packer system, and corresponding zonal isolation method, for perforating a wellbore with one trip into the wellbore.

Referring to FIGS. 5 through 7, the second embodiment of the zonal isolation method and apparatus of the present invention includes an isolation packer system and corresponding zonal isolation method for perforating one or more intervals of a formation penetrated by a wellbore, with one trip into the wellbore, while isolating each perforated interval from every other interval to be perforated.

In FIG. 5, a bridge plug 50 and associated perforating gun 52 and flow sub 54 are run into a deviated wellbore on a tubing 56. The wellbore is cased, at 58, at its upper end and is lined with a liner 60 at its lower, deviated portion of the wellbore. An isolation packer 62, when set, seals the tubing 56 against the casing 58 of the wellbore.

The zonal isolation method for perforating a wellbore during one trip into the wellbore, which utilizes the isolation packer system of FIGS. 5–7, is set forth in the following paragraphs with reference to FIGS. 5–7.

In FIG. 5, the isolation packer 62 is set and the bridge plug 50 is unset. The perforating gun 52 perforates the formation penetrated by the deviated wellbore and leaves a plurality of perforations 64 in the formation. A wellbore fluid begins to flow uphole, through the flow sub 54 and through the tubing 56, to a surface of the wellbore.

In FIG. 6, during the flow uphole, the bridge plug 50, perforating gun 52, and tubing are pulled uphole until the bridge plug 50 is disposed adjacent that portion of the liner 60 which is adjacent the casing 58, that is, a junction point between the liner 60 and casing 58, as shown in FIG. 6. The bridge plug 50 is set. The plug 50 includes a core **50*a*; however, the core 50*a* in FIG. 6 is firmly disposed within the bridge plug 50. The bridge plug 50 can be set and unset; when unset, wellbore fluid is allowed to flow in the liner 60, uphole into the casing 58, and into the flow sub 54. When the bridge plug 50 is set, one can then unseat the isolation packer 62 and pull the isolation packer 62 and perforating gun 52** out of the wellbore.

In FIG. 7, run a completion packer 66 into the wellbore, the completion packer sealing the tubing 56 against the casing 58. Then, pull the core **50*a* out of the bridge plug 50 leaving a full bore 50*b* within the bridge plug 50. The inner diameter of the full bore 50*b* of the bridge plug 50 is approximately equal to the inner diameter of the tubing 56. Production is now established; that is, wellbore fluid is free to flow from the perforations 64 in FIG. 5 uphole through the full bore 50*b* of the bridge plug 50, through the tubing 56, through the completion packer 66**, and uphole to a surface of the wellbore.

Figures 9, 10A, 10B, 10C:
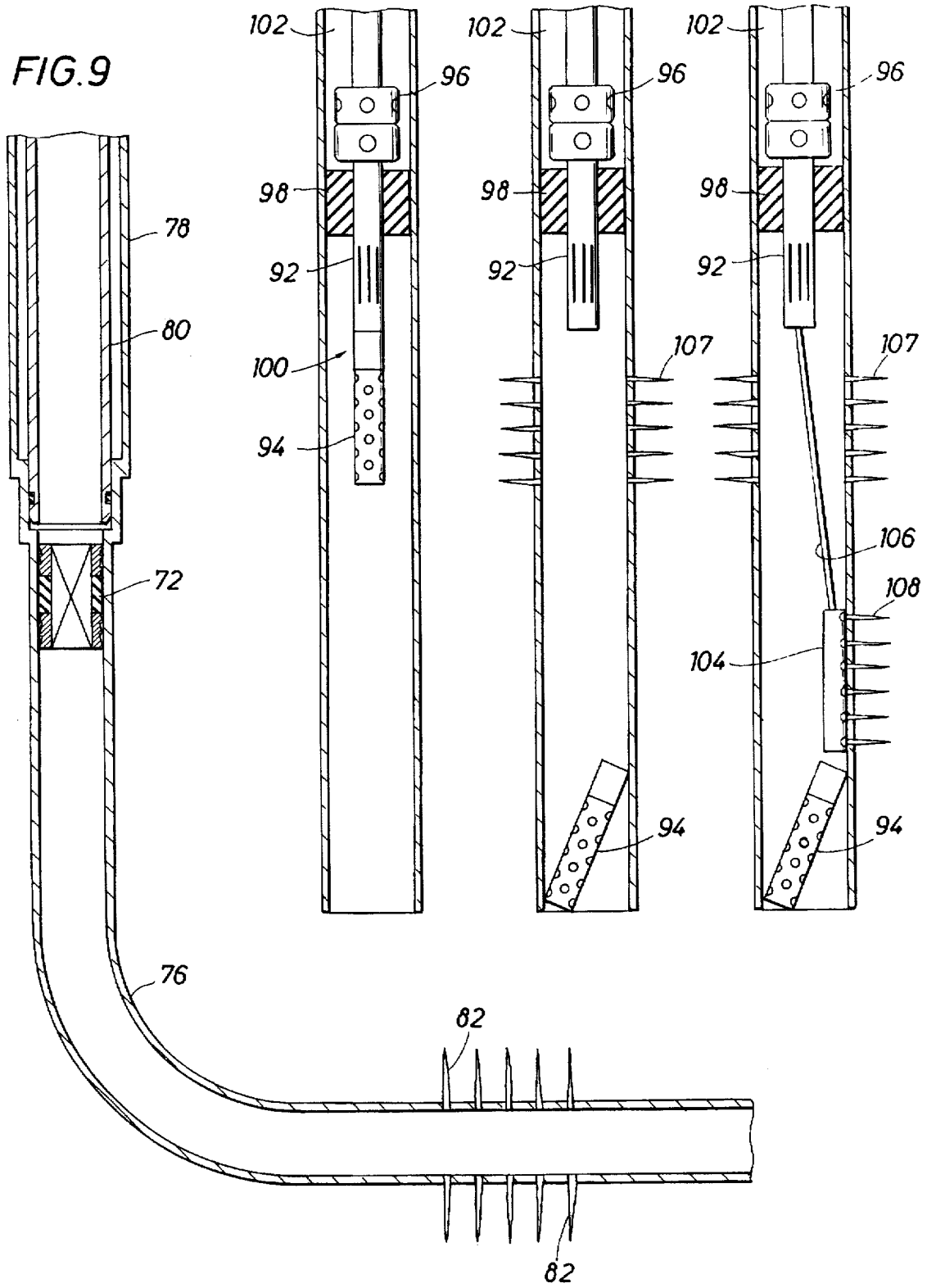
FIG. 10A (PRIOR ART)
FIG. 10B (PRIOR ART)
FIG. 10C (PRIOR ART)
FIGS. 10*a* through 10*c* illustrate a prior art method for perforating a plurality of intervals of a formation penetrated by a wellbore.

Referring to FIGS. 8 and 9, another, third embodiment of the zonal isolation method and apparatus of the present invention is illustrated, this third embodiment including an isolation packer system and corresponding zonal isolation method for perforating a wellbore during one trip into the wellbore.

In FIG. 8, a perforating gun 70 and an attached bridge plug 72 are connected to a tubing 74, the perforating gun, bridge plug, and tubing being disposed within a liner 76 in a wellbore. A top portion of the wellbore is lined with a casing 78 and a bottom portion of the wellbore is lined with the liner 76. In addition, a further tubing 80 is disposed within the casing 78, the tubing 74 being disposed within the further tubing 80 and the liner 76. In FIG. 8, the bridge plug 72 is unset.

The third embodiment of the zonal isolation method and apparatus of perforating a wellbore during one trip in the wellbore in accordance with the present invention, without requiring that a kill fluid be circulated, will be set forth in the following paragraphs with reference to FIGS. 8 and 9.

In FIG. 8, when the bridge plug 72 is unset, the perforating gun 70 detonates and produces a set of perforations 82 in a formation penetrated by the wellbore. The perforating gun 70 and bridge plug 72 are then moved uphole until the bridge plug 72 is disposed adjacent the top portion of the liner 76. The bridge plug 72 is then set, as shown in FIG. 9. The perforating gun 70 and tubing 74 are disconnected from the bridge plug 72 and retrieved to a surface of the wellbore, leaving the bridge plug 72 set adjacent the top portion of the liner 76, as shown in FIG. 9. When it is necessary to establish production (to flow a wellbore fluid from the perforations 82 of FIG. 8 uphole to a surface), unset the bridge plug 72 and remove the plug 72. When the plug 72 is removed, production of the wellbore of FIGS. 8 and 9 will be established. It is not necessary to insert a tubing into the plug, as shown in FIG. 7 because the further tubing 80 of FIG. 9 is already disposed within the casing 78.

In FIGS. 8 and 9, plug 72 is set in order to protect the perforations 82 from annulus pressure, annulus fluid, or a kill fluid circulating in the annulus above the plug 72, the kill fluid being used to achieve overbalance in the wellbore and to kill the well production. The kill fluid can damage the perforations 82; however, since the bridge plug 72 is set, the bridge plug 72 will isolate the perforations 82 from the annulus fluid and pressure and/or kill fluids circulating in the annulus above the bridge plug 72.

Referring to FIGS. 10*a* through 10*c*, a prior art method and apparatus is illustrated for perforating a plurality of zones or intervals of the formation penetrated by the wellbore.

In FIG. 10*a*, a slotted tail pipe 92, a perforating gun 94, and a drill stem test valve 96 are disposed in a wellbore, and a packer 98 encloses the tail pipe 92 effectively sealing off and isolating an annulus 100 below the packer from an annulus 102 above the packer.

In FIG. 10*b*, the perforating gun 94 perforates a formation penetrated by the wellbore and drops to a bottom of the wellbore.

In FIG. 10*c*, a small "through the tubing" perforating gun 104, suspending by wireline 106, is lowered through the tubing of the valve 96 and the tail pipe 92, attaches to a wall of the wellbore, and perforates the formation.

As a result, a plurality of perforations 107, 108 are produced in the wellbore; however, a kill fluid in an overbalanced condition is used to kill the perforated zones prior to retrieving the packer 98 and the perforating guns 94, 104 to a surface of the wellbore.

Referring to FIGS. 11 through 14*d*, a first example of a fourth embodiment of the zonal isolation method and apparatus of the present invention, for perforating a plurality of zones or intervals of a formation with one trip into the wellbore without requiring that a kill fluid be circulated in the wellbore, is illustrated.

Figure 11:
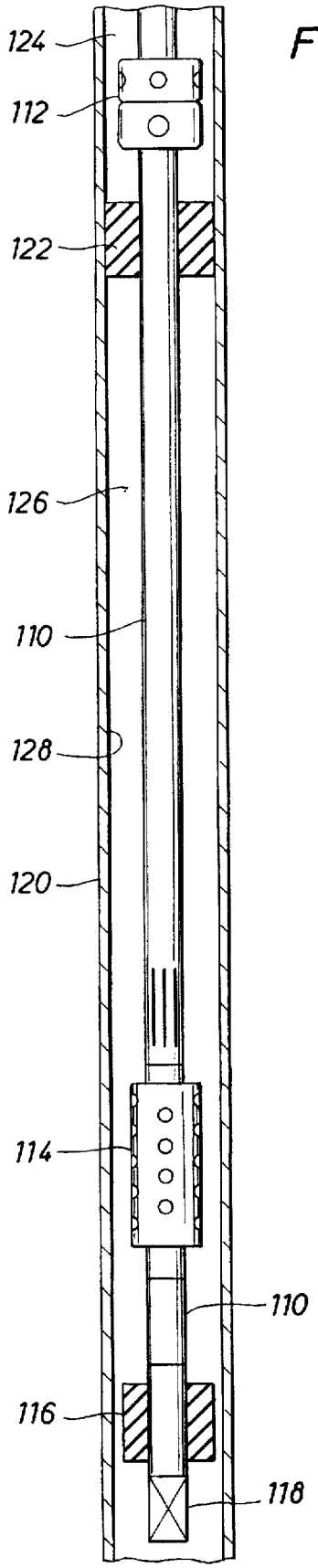
Figure 12:
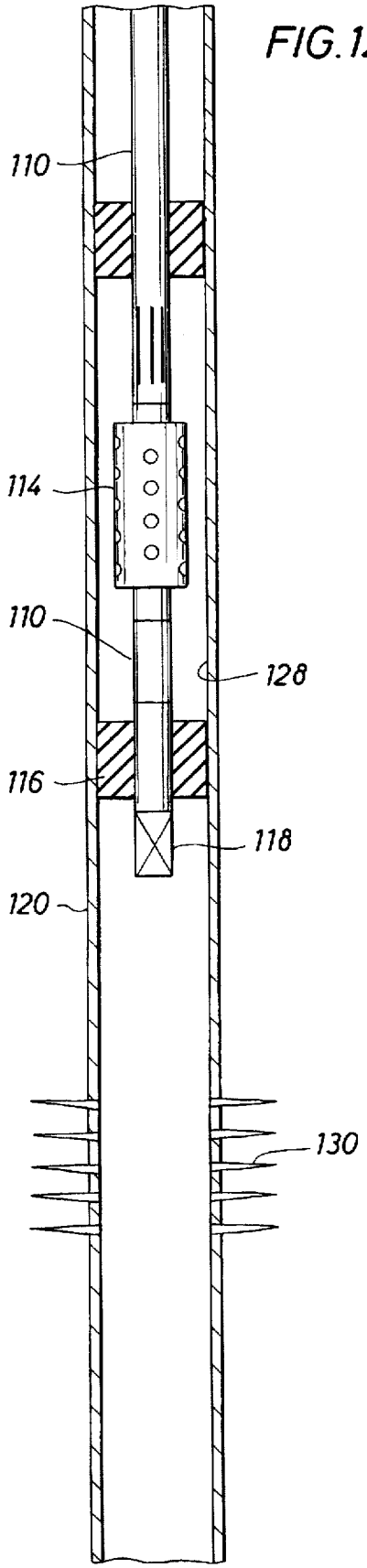

In FIG. 11, the first example of the zonal isolation apparatus, shown in FIGS. 11 and 12 to be disposed in a wellbore 120, includes a tubing 110 having a drill stem test valve 112, a perforating gun 114, a packer or plug 116, and a tubing plug 118. The tubing plug 118 plugs the end of the tubing 110. Another packer 122 seals the tubing 110 against the casing 128 and isolates an annulus 124 above the packer 122 from a rathole annulus 126 below the packer 122.

In FIG. 12, the perforating gun 114 has already perforated a formation penetrated by the wellbore 120 thereby producing a plurality of perforations 130 in the formation, and the perforating gun 114 has already moved uphole a certain distance until the packer or plug 116 and associated tubing plug 118 is situated above the perforations 130 in the wellbore. When the packer or plug 116 and tubing plug 118 is situated above the perforations 130 as shown in FIG. 12, the packer or plug 116 is set thereby sealing the tubing 110 below the perforating gun 114 against the casing 128 in the wellbore, and the tubing plug 118 plugs the end of the production tubing 110. As a result, wellbore fluid flowing from the perforations 130 cannot flow uphole because the plug 116 is set, which seals the tubing 110 against the casing 128, and the tubing plug 118 plugs the end of the tubing thereby preventing any of the wellbore fluid flowing from the perforations 130 from flowing uphole. As a result of the set plug 116 and the tubing plug 118, it is no longer necessary to circulate a kill fluid throughout the perforated wellbore, an action which was previously necessary to prevent the wellbore fluid from the perforations from flowing uphole while the packer and perforating gun are retrieved to a surface of the wellbore.

In FIGS. 13*a* through 13*d*, another example of the fourth embodiment of the zonal isolation method and apparatus of the present invention, for perforating a plurality of zones of a formation penetrated by the wellbore during one trip in the wellbore without requiring the circulation of a kill fluid throughout the wellbore, is illustrated.

In FIGS. 13*a*–13*d*, the zonal isolation apparatus 129 includes a plurality of perforating guns 130, 132, and 134, and a corresponding plurality of plugs/tubing plugs 136, 138, and 140 initially connected to the perforating guns (each plug/tubing plug 136, 138, 140 being identical to the packer or plug 116 and the tubing plug 118 of FIGS. 11 and 12) disposed in a wellbore 141.

Figures 13A, 13B, 13C, 13D:
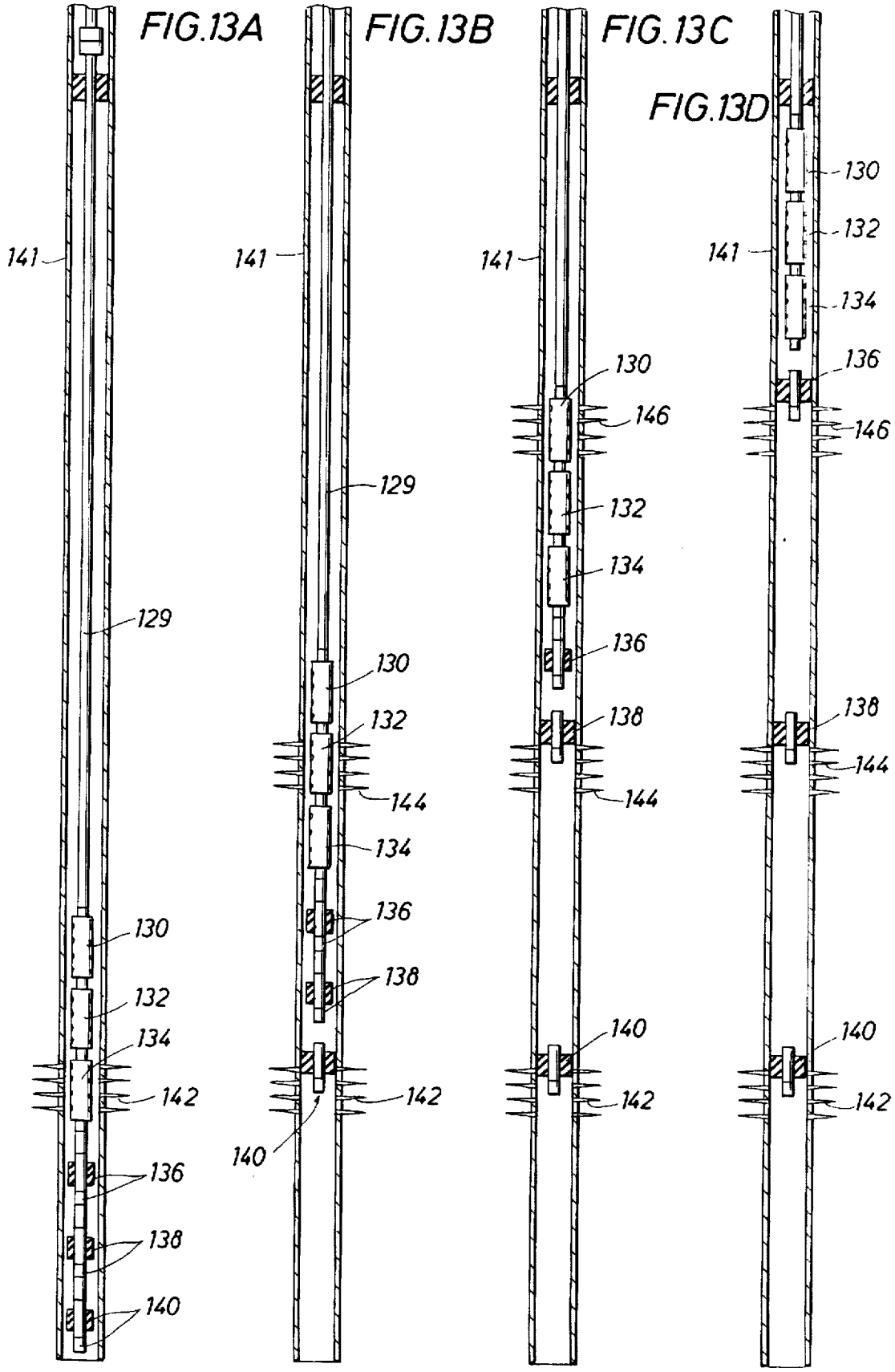

The zonal isolation method of FIGS. 13*a*–13*d* perforates a plurality of zones or intervals 142, 144, and 146 of the wellbore 141, with one trip into the wellbore, without requiring the circulation of a kill fluid in the wellbore to halt the flow of the wellbore fluid flowing from the zones 142, 144, 146 in the following manner:

In FIG. 13*a*, the perforating guns 130, 132, 134 and the plug/tubing plugs 136, 138, 140 are disposed in the wellbore 141 in the manner shown in FIG. 13*a*. The perforating gun 134 perforates the formation penetrated by the wellbore 141 and perforations 142 are created in the zone 142 as shown in FIG. 13*a*. The zonal isolation apparatus 129 is moved upwardly in the wellbore until the plug/tubing plug 140 is situated directly above the perforations 142 in the formation. When the plug/tubing plug 140 is situated directly above the perforations 142, the plug/tubing plug 140 is set in wellbore thereby sealing off and isolating the area below the plug 140 from the area above the plug 140 in the wellbore. The plug/tubing plug 140 is disconnected from the plug/tubing plug 138, and the zonal isolation apparatus 129 of FIG. 13*b* is moved upwardly in the wellbore until the perforating gun 132 is disposed adjacent the zone 144 of the formation penetrated by the wellbore 141. The perforating gun 132 is detonated, and perforations 144 are created in the zone 144 as shown in FIG. 13*b*. The zonal isolation apparatus 129 is moved upwardly in the wellbore until the plug/tubing plug 138 is situated directly above the perforations 144 in the formation. When the plug/tubing plug 138 is situated directly above the perforations 144, the plug/tubing plug 138 is set in wellbore thereby sealing off and isolating the area below the plug 138 from the area above the plug 138 in the wellbore. The plug/tubing plug 138 is disconnected from the plug/tubing plug 136, and the zonal isolation apparatus 129 of FIG. 13*c* is moved upwardly in the wellbore until the perforating gun 130 is disposed adjacent the zone 146 of the formation penetrated by the wellbore 141. The perforating gun 130 is detonated, and perforations 146 are created in the zone 146 as shown in FIG. 13*c*. The zonal isolation apparatus 129 is moved upwardly in the wellbore until the plug/tubing plug 136 is situated directly above the perforations 146 in the formation. When the plug/tubing plug 136 is situated directly above the perforations 146, the plug/tubing plug 136 is set in wellbore thereby sealing off and isolating the area below the plug 136 from the area above the plug 136 in the wellbore. The plug/tubing plug 136 is disconnected from the detonated perforating gun 134, and the zonal isolation apparatus 129 of FIG. 13*d* is moved upwardly in the wellbore. As a result, the perforations 142 are isolated by plug 140 from the perforations 144, 146 before the perforations 144, 146 were created; the perforations 144 are isolated by plug 138 from the perforations 146 before the perforations 146 were created; and the perforations 146 are isolated by plug 136 from the remainder of the wellbore above the plug 136. Consequently, it was never necessary to circulate a kill fluid throughout the wellbore after the perforations were created in order to kill the well so that a packer or perforating gun could be removed from the well.

In FIGS. 14*a* through 14*d*, another example of the fourth embodiment of the zonal isolation method and apparatus of the present invention, for perforating a plurality of zones of a formation penetrated by the wellbore during one trip in the wellbore without requiring the circulation of a kill fluid throughout the wellbore, is illustrated.

In FIGS. 14*a*–14*d*, the zonal isolation apparatus 150 includes a plurality of perforating guns 152, 154, and 156, and a single resettable plug/tubing plug 158 connected to the perforating gun 156 disposed in a wellbore 141. The plug/tubing plug 158 includes (1) a plug or packer, and (2) a tubing plug. The tubing plug will plug the end of the production tubing 160, similar to the tubing plug 118 in FIG. 11; however, the plug or packer part of the plug/tubing plug 158 is a resettable packer or plug, one which can be repeatedly set, unset, set, unset, etc.

Figures 14A, 14B, 14C, 14D:
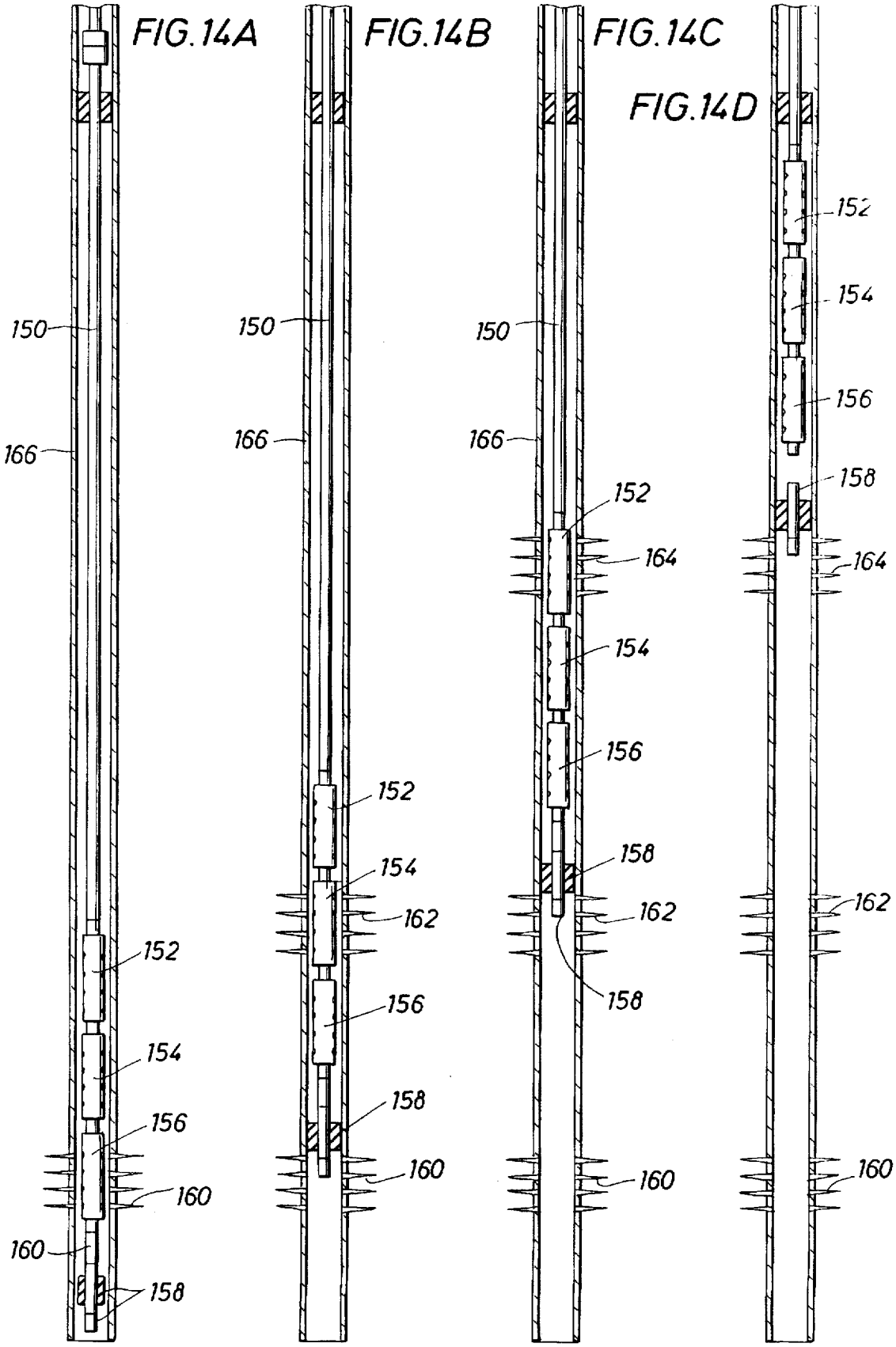

The zonal isolation method of FIGS. 14*a*–14*d* perforates a plurality of zones or intervals 160, 162, and 164 of the wellbore 166, with one trip into the wellbore, without requiring the circulation of a kill fluid in the wellbore to halt the flow of the wellbore fluid flowing from the zones 160, 162, 164 in the following manner:

In FIG. 14*a*, the perforating guns 152, 154, 156 and the resettable plug/tubing plug 158 are disposed in the wellbore 166 in the manner shown in FIG. 14*a*. The perforating gun 156 perforates the formation penetrated by the wellbore 166 and perforations 160 are created in the zone 160 as shown in FIG. 14*a*. The zonal isolation apparatus 150 is moved upwardly in the wellbore until the plug/tubing plug 158 is situated directly above the perforations 160 in the formation. When the plug/tubing plug 158 is situated directly above the perforations 160, the plug/tubing plug 158 is set in wellbore thereby sealing off and isolating the area below the plug 158 from the area above the plug 158 in the wellbore. The perforating gun 154 is now disposed adjacent the zone 162 of the formation penetrated by the wellbore 166. The perforating gun 154 is detonated, and perforations 162 are created in the zone 162 as shown in FIG. 14*b*. The plug/tubing plug 158 is unset and then the zonal isolation apparatus 150 is moved upwardly in the wellbore until the plug/tubing plug 158 is situated directly above the perforations 162 in the formation. When the plug/tubing plug 158 is situated directly above the perforations 162, the plug/tubing plug 158 is set in wellbore thereby sealing off and isolating the area below the plug 158 from the area above the plug 158 in the wellbore. The perforating gun 152 is disposed adjacent the zone 164 of the formation penetrated by the wellbore 166. The perforating gun 152 is detonated, and perforations 164 are created in the zone 164 as shown in FIG. 14*c*. The plug/tubing plug 158 is unset and then the zonal isolation apparatus 150 is moved upwardly in the wellbore until the plug/tubing plug 158 is situated directly above the perforations 164 in the formation. When the plug/tubing plug 158 is situated directly above the perforations 164, the plug/tubing plug 158 is set in wellbore thereby sealing off and isolating the area below the plug 158 from the area above the plug 158 in the wellbore. The plug/tubing plug 158 is disconnected from the detonated perforating gun 156, and the zonal isolation apparatus 150 of FIG. 14*d* is moved upwardly in the wellbore. As a result, the perforations 160 are isolated by plug 158 from the perforations 162, 164 before the perforations 162, 164 were created; the perforations 162 are isolated by plug 158 from the perforations 164 before the perforations 164 were created; and the perforations 164 are isolated by plug 158 from the remainder the wellbore above the plug 158. Consequently, it was never necessary to circulate a kill fluid throughout the wellbore after the perforations were created in order to kill the well so that a packer or perforating gun could be removed from the well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A zonal isolation apparatus adapted to be disposed in a wellbore, comprising:

perforating means for perforating a zone of a formation penetrated by said wellbore, a particular position in said wellbore being located directly above the zone in said wellbore, wherein said perforating means comprises a plurality of perforating means for perforating, respectively, a plurality of the zones of said formation penetrated by said wellbore; and means connected to said perforating means for plugging said particular position in said wellbore after said perforating means perforates the zone.

2. The zonal isolation apparatus of claim 1, wherein the means for plugging comprises a plurality of plugging means for plugging a respective plurality of the particular positions in said wellbore, said plurality of particular positions being located directly above the respective plurality of zones of said formation.

3. A method of perforating a formation penetrated by a wellbore, comprising:

sequentially perforating a plurality of parts of said formation thereby producing a plurality of perforations in said formation; and plugging a portion of said wellbore, said portion being located directly above one of said perforations in said formation.

4. The method of claim 3, wherein the plugging step comprises the step of:

sequentially plugging a plurality of said portions of said wellbore located directly above, respectively, said plurality of parts of said formation where said plurality of perforations are produced in said formation.

5. An apparatus adapted to be disposed in a wellbore for isolating a zone of a formation penetrated by said wellbore, comprising:

perforating means for perforating said zone of said formation; and packer means connected to a bottom of said perforating means for packing off and plugging a potion of said formation which is located directly above said zone of said formation being perforated after said perforating means perforates said zone of said formation.

6. The apparatus of claim 5, wherein said perforating means comprises a plurality of perforators adapted for perforating a plurality of the zones of said formation.

7. The apparatus of claim 6, wherein said packer means comprises a plurality of packers or plugs adapted for packing off and plugging a plurality of the portions of said formation which are located, respectively, directly above the plurality of the zones of said formation.

8. The apparatus of claim 6, wherein said packer means comprises a packer or plug adapted for packing off and plugging a portion of said formation which is located directly above a particular one of the plurality of the zones of said formation, said particular one of the plurality of the zones being an uppermost zone of said formation in said wellbore being perforated.

9. The apparatus of claim 5, wherein said packer means includes a core adapted to be removed when said packer means packs off and plugs aid portion of said formation, said packer means having a full bore when said core is removed adapted to receive a tubing string having a diameter approximately equal to a diameter of said full bore.

10. A method of isolating a pair of zones of a formation in a wellbore, a corresponding pair of perforations adapted to be produced in said pair of zones of said formation, comprising the steps of:

(a) plugging or packing off a part of said formation which is located directly above a first zone of said pair of zones of said formation after a first one of said pair of perforations is produced in said first zone; and (b) following the plugging step (a), plugging or packing off a part of said formation which is located directly above a second zone of said pair of zones of said formation after a second one of said pair of perforations is produced in said second zone.

* * * * *